US011325236B2

(12) United States Patent
Hyde

(10) Patent No.: US 11,325,236 B2
(45) Date of Patent: May 10, 2022

(54) INSULATED MULTI-TOOL

(71) Applicant: EDENSOR GROUP PTY LTD, Idalia (AU)

(72) Inventor: Ben Hyde, Brisbane (AU)

(73) Assignee: Edensor Group PTY LTD, Queensland (AU)

( * ) Notice: Subject to any disclaimer, the term of this patent is extended or adjusted under 35 U.S.C. 154(b) by 232 days.

(21) Appl. No.: 16/332,086

(22) PCT Filed: Nov. 24, 2017

(86) PCT No.: PCT/AU2017/051300

§ 371 (c)(1),
(2) Date: Mar. 11, 2019

(87) PCT Pub. No.: WO2018/094471

PCT Pub. Date: May 31, 2018

(65) Prior Publication Data

US 2021/0023688 A1 Jan. 28, 2021

(30) Foreign Application Priority Data

Nov. 24, 2016 (AU) ..... 2016102032

(51) Int. Cl.
*B25F 1/04* (2006.01)
*B25F 1/00* (2006.01)
(Continued)

(52) U.S. Cl.
CPC ..... *B25F 1/04* (2013.01); *B25F 1/003* (2013.01); *B25B 7/22* (2013.01); *B25G 1/085* (2013.01)

(58) Field of Classification Search
CPC ..... B25B 7/22
See application file for complete search history.

(56) References Cited

U.S. PATENT DOCUMENTS 1,946,239 A * 2/1934 Ryan ..... B25G 1/125 81/436
5,497,522 A 3/1996 Chen
(Continued)

FOREIGN PATENT DOCUMENTS

CN 203019250 U 6/2013
DE 202007015100 U1 3/2008
(Continued)

OTHER PUBLICATIONS

International Search Report, PCT/AU2017/015300, dated Feb. 20, 2018.
EESR, EP 3544771.

*Primary Examiner* — Hadi Shakeri
(74) *Attorney, Agent, or Firm* — Boyle Fredrickson S.C.

(57) ABSTRACT

An insulated multi-tool comprising a pair of opposing jaws, a pair of opposed handles operatively connected to the jaws relative to a pivot to force the jaws into a clamping position about an object, at least one of the opposed handles having a tool-receiving pocket, at least one tool stored in the tool receiving pocket, the at least one tool pivotally attached relative to the tool receiving pocket for movement between a stored position in which the at least one tool is stored within the tool receiving pocket and an open, use position in which the at least one tool is located relative to at least one of the opposed handles for use, and wherein the a pair of opposed handles are electrically insulated from both the pair of opposing jaws and each at least one tool.

21 Claims, 10 Drawing Sheets

(51) Int. Cl.
*B25B 7/22* (2006.01)
*B25G 1/08* (2006.01)

(56) References Cited

U.S. PATENT DOCUMENTS

| | | | | |
|---|---|---|---|---|
| 5,664,274 | A | 9/1997 | Collins | |
| 5,682,641 | A * | 11/1997 | Newman, Jr. | B05C 17/0205 15/144.4 |
| 6,014,787 | A | 1/2000 | Rivera | |
| 6,128,805 | A | 10/2000 | Rivera | |
| 6,216,301 | B1 | 4/2001 | Rivera | |
| 6,588,040 | B2 | 7/2003 | Rivera | |
| 6,655,240 | B1 * | 12/2003 | DeVecchis | B25G 1/125 81/177.1 |
| 6,857,154 | B2 | 2/2005 | Rivera | |
| 7,020,922 | B2 | 4/2006 | Rivera | |
| 7,343,838 | B2 * | 3/2008 | Tansbo | A01L 11/00 7/168 |
| 7,997,170 | B1 * | 8/2011 | Martinez | B25F 1/04 81/427.5 |
| 8,052,104 | B2 * | 11/2011 | Clampitt | F16M 11/18 248/178.1 |
| 9,925,654 | B2 * | 3/2018 | Ragner | B25F 1/04 |
| 2001/0018779 | A1 | 9/2001 | Rivera | |
| 2003/0192128 | A1 | 10/2003 | Rivera | |
| 2005/0120487 | A1 | 6/2005 | Rivera | |
| 2016/0288309 | A1 * | 10/2016 | Rauwerdink | B25F 1/04 |
| 2018/0043523 | A1 * | 2/2018 | Sze | B25B 7/08 |

FOREIGN PATENT DOCUMENTS

| | | | |
|---|---|---|---|
| FR | 2944726 | A1 | 10/2010 |
| WO | 2016160845 | A1 | 10/2016 |

* cited by examiner

INSULATED MULTI-TOOL

CROSS-REFERENCE TO RELATED APPLICATIONS

This application is a 371 U.S. National Phase Entry of PCT/AU2017/051300, international filing date Nov. 24, 2017, which claims priority to AU 2016102032, filed Nov. 24, 2016, the entire contents of each hereby expressly incorporated by reference in their entirety.

TECHNICAL FIELD

The present invention relates generally to multi-tools.

BACKGROUND ART

Multi-tools typically are pliers-based hand tools having one or more tools stored in one or both of the handles of the pliers.

Other pliers-like devices may be the basis for a multi-tool, such as scissors or wire cutters. The common element among pliers, scissors and wire cutters is that each includes a pair of opposing jaws operated by a pair of opposing handles. When the handles of such a jaw/handle combination store one or more tools, the entire device is a multi-tool.

The tools may be stored in a pocket formed in the handle. Examples of tools found in multi-tool handles include knife blades, can openers, screwdrivers, files, scissors, and saw blades. These tools fold into and out of the handle of the multi-tool, similar to a knife blade folding into and out of a pocket knife, and thus may be referred to in this document as foldable tools. Multi-tools often include other tools that do not fold, such as a ruler stamped into an exposed surface of one or both handles of the multi-tool.

Whilst multi-tools are extremely useful because of their small size and the variety of tools included, all multi-tools are manufactured from metal due to the need for strength and robustness in the multi-tool.

It will be clearly understood that, if a prior art publication is referred to herein, this reference does not constitute an admission that the publication forms part of the common general knowledge in the art in Australia or in any other country.

SUMMARY OF INVENTION

The present invention is directed to an insulated multi-tool, which may at least partially overcome at least one of the abovementioned disadvantages or provide the consumer with a useful or commercial choice.

With the foregoing in view, the present invention in one form, resides broadly in an insulated multi-tool comprising a pan of opposing jaws, a pair of opposed handles operatively connected to the jaws relative to a pivot to force the jaws into a clamping position about an object, at least one of the opposed handles having a tool-receiving pocket, at least one tool stored in the tool receiving pocket, the at least one tool pivotally attached relative to the tool receiving pocket for movement between a stored position in which the at least one tool is stored within the tool receiving pocket and an open, use position in which the at least one tool is located relative to at least one of the opposed handles for use, and wherein the a pair of opposed handles are electrically insulated from both the pair of opposing jaws and each at least one tool.

The multi-tool of the present invention includes a pair of opposing jaws connected to a pair of handles. The handles are operatively connected to the jaws relative to a pivot so that movement of the handles can be used to operate jaws, much like the handles on conventional pliers operate plier jaws.

The jaws of the multi-tool of the present invention may be of any type. The jaws may have any pattern or configuration. The jaws may each be a combination jaw and may therefore include cutting blades in particular wire cutting blades as well as one or more gripping portions such that the jaws when move together, can be used to grip. Further, the jaws may include portions which allow other functions such as wire stripping, spreader configurations, wire crimping and other functions which would normally be performed by one or more tools having a pair of opposed jaws.

The jaws are operatively connected to a respective handle of the pair of opposed handles relative to a pivot to force the jaws into a clamping position about an object.

At least one of the handles preferably has at least one elongate tool-receiving pocket that extends approximately parallel to the longitudinal axis of the handle. At least one of the handles of the present multi-tool may be formed to include two oppositely facing pockets in which tools may be stored. When viewed along the handles, approximately perpendicular to the longitudinal axis of the handles, at least one of the handles may be formed so that its body has a cross section that is substantially U-shaped or S-shaped. The other handle may be U-shaped or S-shaped. Preferably, in circumstances where one of the handles has an S shaped cross-section, the other of the handles preferably includes at least one pocket that faces toward the S-shaped handle so that the pressed-together locking position of the handles may be used to lock open, foldable tools stored in the other handle.

Forming oppositely facing pockets in a single handle allows at least one foldable tool to be exposed regardless of the orientation of the tool-receiving handle relative to the opposing handle. Thus, the exposed tool may be opened and closed even if the plier jaws are clamped about an object. The exposed tool also may be a foldable tool, while the tool in the oppositely facing pocket may be a non-foldable tool. A further alternative made possible by the oppositely facing pockets of the present multi-tool is that the exposed tool may be opened and closed while another foldable tool is locked in an open position by the pressed-together locking position of the handles, just described.

Pockets may be formed such that the handles of the multi-tool can be rotated back about on themselves such that the jaws of the multi-tool can be received at least partially in one or more respective pockets.

The multi-tool will include at least one tool storable in a closed position within the one of the tool receiving pockets, the tool attached to the one of the tool-receiving pockets by a pin so that the tool is pivotable from the closed position to an open position extending away from the one of the tool-receiving pockets by an angle, preferably of at least approximately 90-degrees relative to the closed position of the tool.

Any number of tools may be provided within one of the tool receiving pockets in any type of tool can be provided. Normally, a number of tools will be provided and the particular combination of tools which arc provided on any multi-tool will normally be chosen for a particular application or use. The intention behind the multi-tool is preferably to minimise the size of the multi-tool whilst mounting a useful variety of tools for the operator.

In one particularly preferred embodiment, an electrician for example may require a flat screwdriver, the Phillips head screwdriver and pliers. The multi-tool of the present invention can provide all of these tools in one compact multi-tool. More than one size of tool may be provided. For example, a single multi-tool may mount more than one different size of flat screwdriver and/or more than one different size of Phillips head screwdriver.

Another particularly preferred tool which may be included in the multi-tool of the present invention is a small torch, preferably stored in one of the tool receiving pockets but deployable from the tool receiving pocket in order to direct light onto a work surface. It is particularly preferred that if a torch is provided that the torch can provide or direct light onto a work surface when the multi-tool is in normal use using one or more of the tools provided and/or the jaws of the multi-tool Where a torch is provided, is preferably actuable between the on and off conditions by a twisting motion of at least a portion of the torch. Preferably, the torch can only be actuable to the on condition when deployed from the respective tool receiving pocket.

Often there is a degree of free play movement of the at least one tools to allow movement between the storage and open conditions. The free play movement of the at least one tool when in the open position is preferably minimised or eliminated by a positive lock provided by an outwardly extending shoulder formed on the foldable tools, adjacent the end of the tool and adjacent the pin on which the tool pivots. The shoulder preferably interacts with a flange formed on the opposing handle. The flange acts to exert a concentrated force against the shoulder of the foldable tool, preferably when the handles are in the pressed-together position, and limits the amount of free play when the tool is in this locked position.

A clasp may be connected to one of the handles, and pivotable into engagement with the other of the handles to lock the handles in the pressed-together position, if desired.

A post may be mounted on at least one of the foldable tools. The post is preferably exposed for engagement by a human hand to facilitate one-handed deployment of the foldable tool from its closed position to its open position. This is particularly useful when the post is mounted on the exposed tool in one of the oppositely facing pockets.

According to a particularly preferred embodiment of the present invention, the pair of opposed handles are electrically insulated from both the pair of opposing jaws and each at least one tool. The electrical installation can be achieved in any way and using any method or apparatus. For example, the electrical installation may include coating the whole of or at least a part of either or both of the handles and/or each of the at least one tools or providing one or more insulating sleeves.

Alternatively or in addition to the coating or sleeve, one or more insulating members may be provided between each at least one tool and each other at least one tool and/or between the mounts of the tools and the pockets in the handles. In this particular configuration, an electrical insulation annular member may be provided between each of the tools and the outermost tools and the inside of the respective tool receiving pocket. Further, an isolating member or assembly may be provided as a part of the pivot mechanism provided between the jaws in order to electrically isolate one of the jaws from the other of the jaws.

In a particularly preferred configuration, the handles themselves will be coated with an insulating coating, an isolating member or assembly will be provided as part of the pivot mechanism provided between the jaws and an annular isolating member will be provided between each at least one tool in the same pocket and between the outermost tools on either end and the inside of the respective tool receiving pocket.

Any form of insulating member or material may be used but a particularly preferred material will be XHHW cross linked polyethylene or PVC with nylon coating. The insulating member or material used will preferably be able to fully insulate the user from the operating surfaces of the multi-tool and the individual tools up to approximately 1000 V.

In a preferred embodiment, the multi-tool of the present invention includes a pair of opposed bodies which are pivotally connected to one another, each body having a jaw and a handle with at least one body having a pair of spaced apart arms in a handle region. Preferably, both bodies have a pair of spaced apart arms and handle region.

Preferably, each body is formed by connecting two lateral body sides together longitudinally. Preferably, the body sides will be pressed together between the jaw and a pivot portion with the pair of spaced apart arms extending rearwardly from adjacent to, but behind, the pivot portion. The body sides can be connected in any way, but preferably, the body sides will be connected to one another using heat and pressure to effectively pressure weld a pair of preferably metal body sides to one another. Connecting the body sides together will preferably form a body that has a jaw and a pivot portion and a pair of spaced apart arms extending longitudinally from adjacent to, but behind the pivot portion.

The arms are typically substantially parallel to one another and spaced apart to define a gap or space between which the at least one tool will be received when in the stored position. Typically, each of the arms has an enlarged rear portion, located furthest from the jaw. Preferably, each of the arms has an opening through which a pin or locking screw is received in order to mount the at least one tool relative to each of the arms and the opening is typically through the enlarged portion. The pin or locking screw will preferably not only mount the at least one tool relative to a body, but also allow rotation of the at least one tool between the stored and open positions.

An insulating handle portion is typically over moulded, over at least a portion of the body. Typically, the over moulded insulating handle portion extends from behind the pivot portion and extends rearwardly over the remainder of the body. The over moulded handle portion will form, or form a part of a grip. It is important that the over moulded insulating handle portion surrounds the spaced apart arms on all sides of each of the arms and typically, the over moulded handle portion will surround the arms on all sides up to a position adjacent to the pivot neck. The over moulded handle portion will act to insulated the user's hand from the jaw of the body.

The over moulded handle portion will preferably have an enlarged forward guard portion extending substantially radially about the handle portion and a shaped grip.

The over moulded handle portion will typically include a shaped channel, preferably located between the (over moulded) pair of spaced apart arms of the body in order to receive the at least one tool at least partially therein. In a preferred form, the channel will typically be elongate and preferably rectangular in cross-section. Preferably, the channel will typically be longer than the at least one tool. In particular, a void or empty portion of the channel will be provided at the jaw-end of the channel in order to allow a user to insert their finger into the channel at a forward end of the at least one tool in order to manually release the at least one tool from the stored position.

In a preferred embodiment, a latch mechanism is typically provided to releasably latch the at least one tool in the stored and/or open positions. In one form, the latch mechanism may include one or more lug or extension or protrusion provided on an inner portion of the tool mount of the handle portion used to mount the at least one tool relative to the handle portion with at least one, and typically a number of corresponding shaped lugs or extensions or protrusions or depressions or similar provided on an over moulded mount for the at least one tool. The latch mechanism will typically provide tactile and/or audible feedback of the movement of the at least one tool into the stored and/or open positions.

Each of the at least one tools is provided in association with the multi-tool of the present invention will typically be provided with a metal shaft located behind a tip or bit. Preferably, an over moulded mount will be provided moulded over, and typically completely about the shaft of each at least one tool. The over moulded mount will typically be manufactured from a nonconductive material and will therefore typically insulate the tool relative to the handle.

Preferably, the over moulded mount is provided with an opening to mount the tool relative to a respective handle, with the opening preferably provided in an enlarged tool mount portion, opposite the tip or bit.

Normally, the shaft of each of the tools will stop short of the opening used to mount the tool mount relative to the handle. Typically, shaft of each of the tools is shaped to engage with the over moulded mount to minimise and preferably substantially prevent rotation of the shaft within the over moulded mount. For example, the shaft will normally have at least one, and typically a number of extensions extending radially from the shaft.

Each handle will typically have a pair of tools with the tools typically matched, for example a pair of flat screwdrivers on one handle with a pair of Philips head screwdrivers on the other handle. The tools are mounted for individual rotation. Typically, a bush will be provided between the over moulded mount of each of the tools in order to allow easy independent rotation of one tool relative to the other.

The at least one tool is preferably mounted relative to a respective handle using a locking screw provided through the opening in the over moulded handle portion and through the openings in the respective over moulded mount of each of the tools. Typically, the locking screw will have a pair of corresponding portions, each having an enlarged head, one of the portions having an internally threaded opening and the other of the portions having an elongate shank with an externally threaded portion. The enlarged head of each of the portions will typically have engagement formations to allow a tool to be engaged to lock and unlock the locking screw. The provision of a locking screw will allow a user to remove the screw to change tools if necessary. It is preferred that the enlarged head of each of the portions will typically be over moulded, normally with an insulating material. The locking screw will normally be isolated from the spaced apart arms of the body is by the insulating over moulded handle and will also be isolated from the respective tools because of the over moulded mount.

The over mould material is important, firstly because the over mould material will primarily be nonconductive in order to insulate various portions of the multi-tool from each other but also, the material or materials chosen will need to be resilient where required for comfort but more rigid and strong in areas where load will be experienced for example, about the tool mount. One or more nonconductive materials can be used in order to provide particular material characteristics in locations as required. Generally, in any position where torque may be experienced during use of the tool, multiple materials could be used with one of the materials used preferably being a rigid and/or stronger material more centrally located and a softer, more comfortable material provided at or towards an outer portion for comfort during use.

The multi-tool of the present invention will also typically include an enhanced visibility portion which may be provided in any manner. For example, one or more portions may be provided on the multi-tool of the present invention which may be reflective, luminous, phosphorescent, chemiluminescent, or photoluminescent. Some of these mechanisms of enhancing visibility are more preferred than others due to their ability to emit light for extended periods, albeit at relatively low levels. It is particularly preferred that any enhanced visibility be provided with the preferred coating of the handles in order that the coating be both electrically insulating and provide enhanced visibility functionality.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Various embodiments of the invention will be described with reference to the following drawings, in which.

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DESCRIPTION OF EMBODIMENTS

According to a particularly preferred embodiment of the present invention, an insulated multi-tool is provided.

Figure 1:
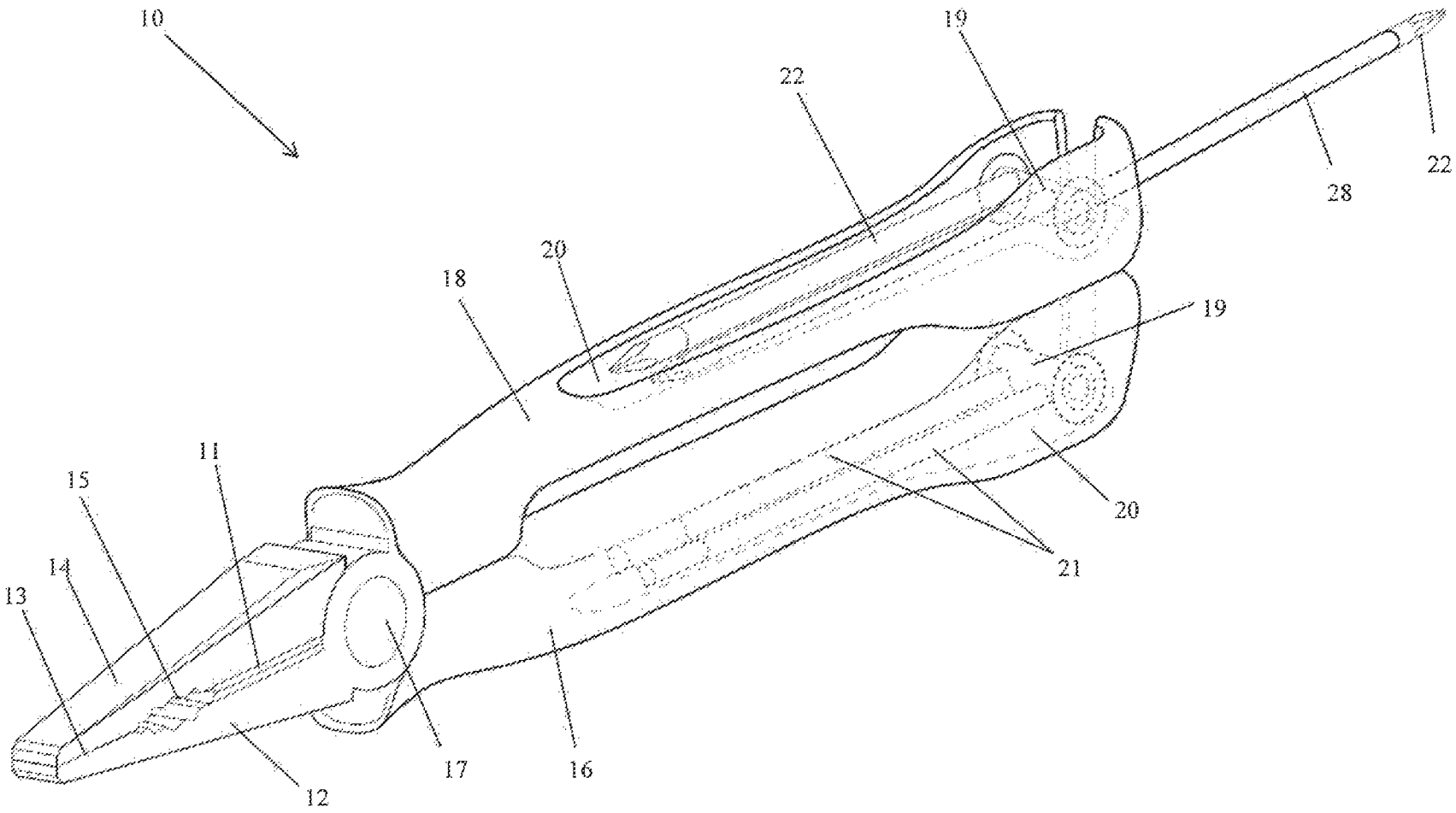
FIG. 1 is an isometric view of a multi-tool according to a preferred embodiment of the present invention.

The insulated multi-tool 10 illustrated in FIG. 1 includes a pair of opposing jaws 12 and 14 connected to a pair of handles 16 and 18. Handles 16 and 18 are used to operate jaws 12 and 14. Handles 16 and 18 therefore are operatively connected or attached to jaws 12 and 14 relative to a pivot so that movement of the handles can be used to operate jaws, much like the handles on conventional pliers operate plier jaws.

The jaws 12, 14 of the multi-tool may have any pattern or configuration. The jaws of the illustrated embodiment are each a combination jaw and include cutting blades 11 as well as a planar gripping portion and an arcuate gripping portion such that the jaws when move together, can be used to grip.

The jaws 12, 14 are operatively connected to a respective handle of the pair of opposed handles 16, 18 relative to a pivot assembly 17 to force the jaws 12, 14 into a clamping position about an object.

In the illustrated embodiment, each of the handles 16, 18 has an elongate tool-receiving pocket 20 that extends approximately parallel to the longitudinal axis of the respective handle. The pocket 20 may have a closed base or may take the form of a slot opening through the handle, allowing at least one foldable tool to be exposed regardless of the orientation of the tool-receiving handle relative to the opposing handle.

The pockets 20 may be formed such that the handles 16, 18 of the multi-tool 10 can be rotated back about on themselves such that the jaws of the multi-tool can be received at least partially in one or more respective pockets 20 as illustrated by the larger arrows in FIG. 1.

The multi-tool 10 includes tools storable in a closed position within the one of the tool receiving pockets 20, attached relative to the one of the tool-receiving pockets 20 by a pin 19 so that the tool is pivotable from the closed position to an open position extending away from the one of the tool-receiving pockets 20 by an angle, preferably of at least approximately 90-degrees relative to the closed position of the tool.

Any number of tools may be provided within one of the tool receiving pockets in any type of tool can be provided. Normally, a number of tools will be provided and the particular combination of tools which are provided on any multi-tool will normally be chosen for a particular application or use. The intention behind the multi-tool is preferably to minimise the size of the multi-tool whilst mounting a useful variety of tools for the operator.

In the particularly preferred embodiment illustrated in FIG. 1, an electrician for example may require a flat screwdriver, the Phillips head screwdriver and pliers. The multi-tool 10 of the present invention provides all of these tools in one compact multi-tool. The illustrated multi-tool 10 mounts a pair of different sized flat screwdrivers 21 and a pair of different sized Phillips head screwdrivers 22. Preferably, the flat screwdrivers are provided relative to one of the handles and the Phillips head screwdrivers are provided relative to the other of the handles.

Often there is a degree of free play movement of the at least one tools to allow movement between the storage and open conditions. The free play movement of the at least one tool when in the open position is preferably minimised or eliminated by a positive lock provided by an outwardly extending shoulder formed on the foldable tools, adjacent the end of the tool and adjacent the pin on which the tool pivots. The shoulder preferably interacts with a flange formed on the opposing handle. The flange acts to exert a concentrated force against the shoulder of the foldable tool, preferably when the handles are in the pressed-together position, and limits the amount of free play when the tool is in this locked position.

A clasp may be connected to one of the handles, and pivotable into engagement with the other of the handles to lock the handles in the pressed-together position, if desired.

A post 24 may be mounted on at least one of the foldable tools. The post is preferably exposed for engagement by a human hand to facilitate one-handed deployment of the foldable tool from its closed position to its open position. This is particularly useful when the post is mounted on the exposed tool in one of the oppositely facing pockets.

According to a particularly preferred embodiment of the present invention, the pair of opposed handles arc electrically insulated from both the pair of opposing jaws and each at least one tool. The electrical installation can be achieved in any way and using any method or apparatus.

In the particularly preferred configuration, the handles 16, 18 are coated with an insulating coating, an isolating member or assembly will be provided as part of the pivot assembly 17 provided between the jaws 12, 14 and an annuls isolating member 27 is provided between each at least one tool in the same pocket 20 and between the outermost tools on either end and the inside of the respective tool receiving pocket 20.

Figure 2:
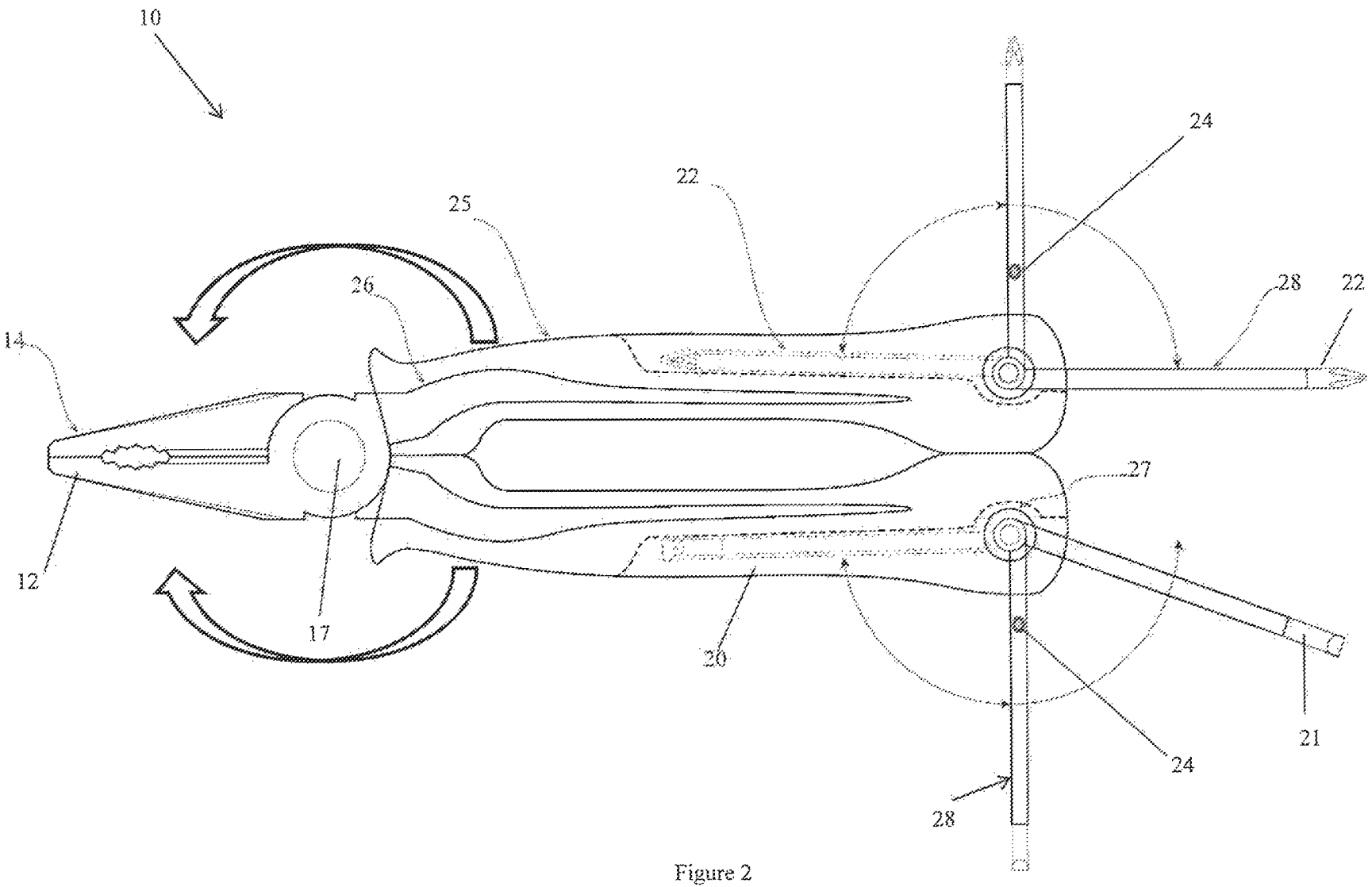
FIG. 2 is a partially transparent side view of a multi-tool according to a preferred embodiment of the present invention.
Figure 7:
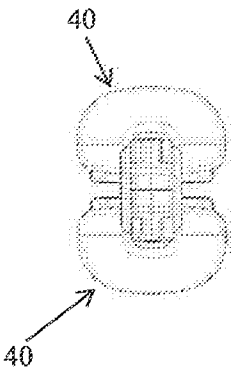
FIG. 7 is a view from the right side of the multi-tool illustrated in FIG. 3.
Figure 4:
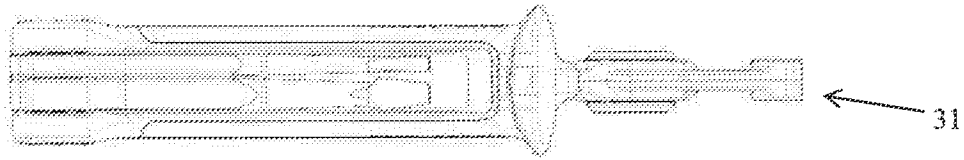
FIG. 4 is a view from above of the multi-tool illustrated in FIG. 3.
Figure 3:
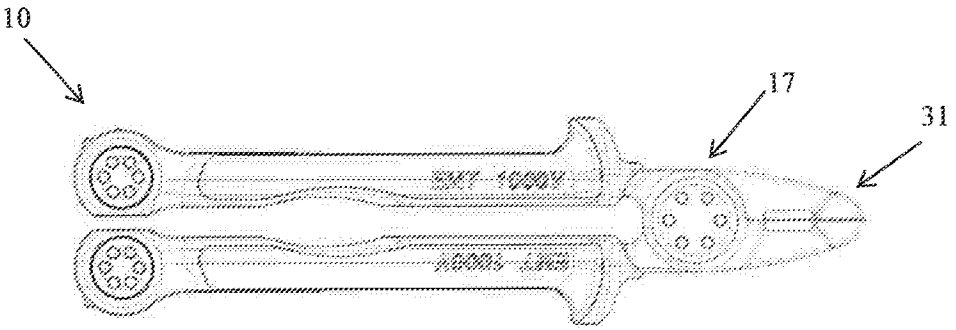
FIG. 3 is a view from the side of a multi-tool according to a preferred embodiment of the present invention.
Figure 5:
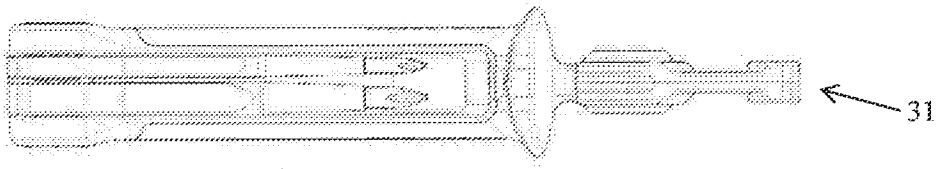
FIG. 5 is a view from below of the multi-tool illustrated in FIG. 3.
Figure 6:
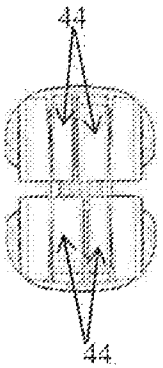
FIG. 6 is a view from the left side of the multi-tool illustrated in FIG. 3.
Figure 9:
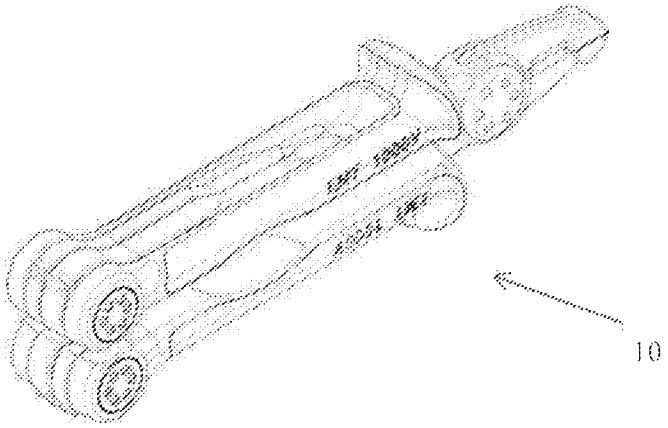
FIG. 9 is an isometric view from an upper, rear end of the multi-tool illustrated in FIG. 3.
Figure 11:
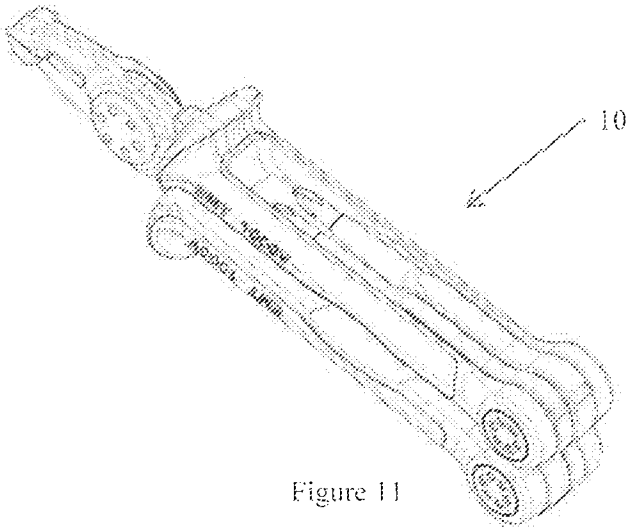
FIG. 11 is an isometric view of the multi-tool illustrated in FIG. 9, inverted.
Figure 8:
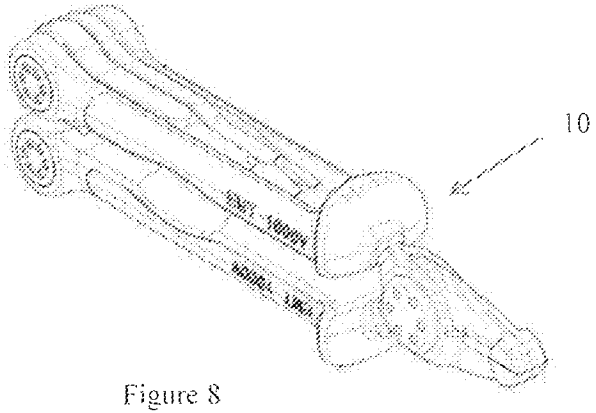
FIG. 8 is an isometric view from an upper, forward end of the multi-tool illustrated in FIG. 3.
Figure 10:
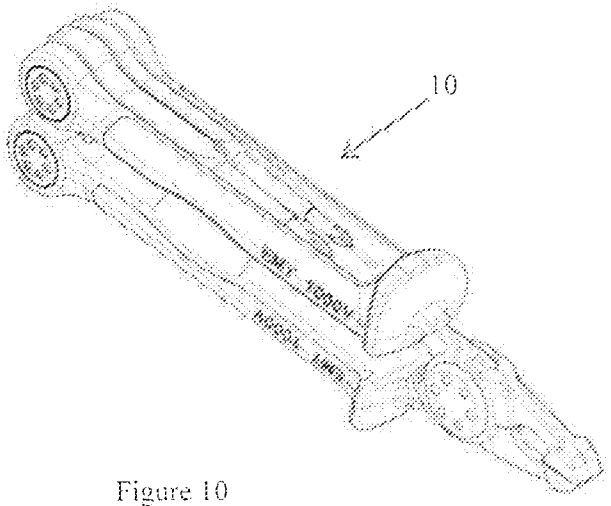
FIG. 10 is an isometric view of the multi-tool illustrated in FIG. 8, inverted.
Figure 12:
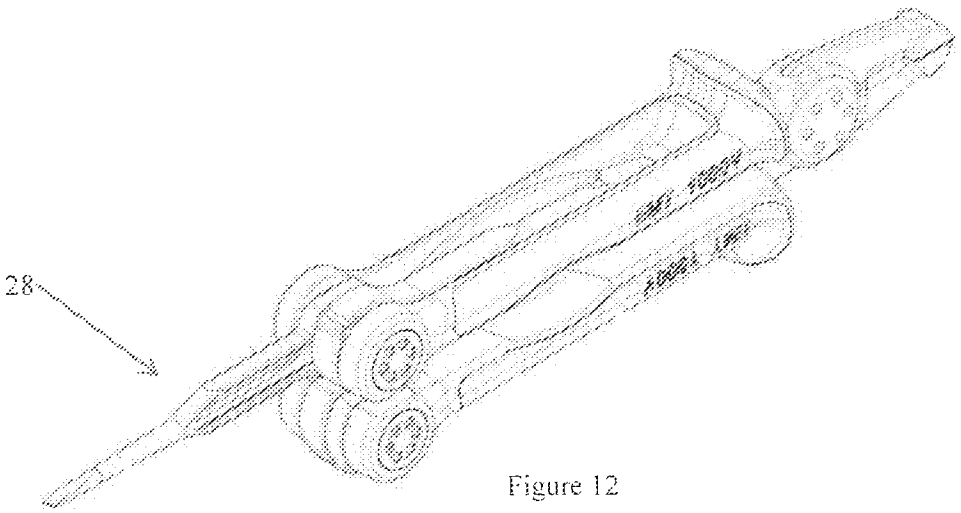
FIG. 12 shows the multi-tool illustrated in FIG. 9, with one tool in the use position.
Figure 13:
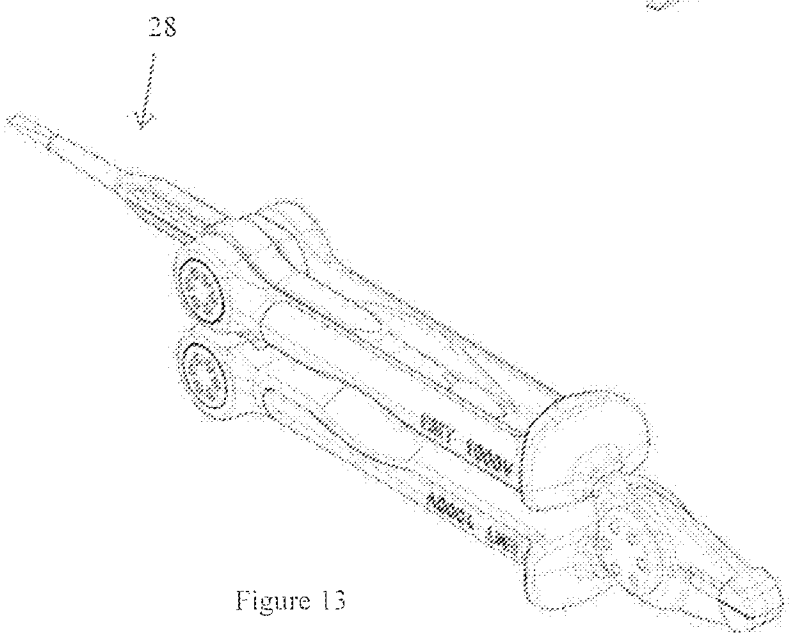
FIG. 13 is an alternative view of the configuration illustrated in FIG. 12.
Figure 15:
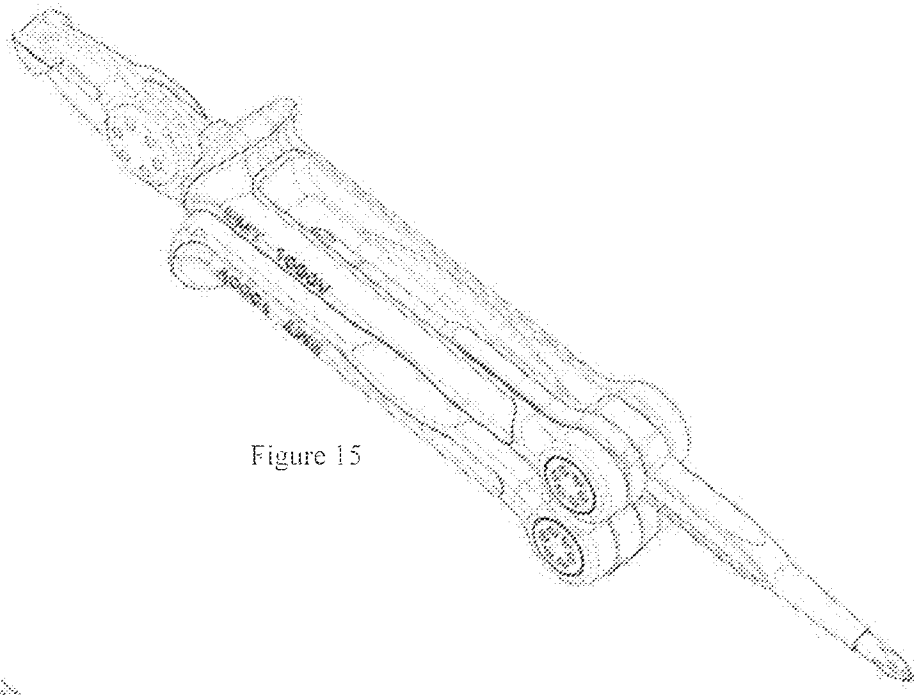
FIG. 15 is an alternative view of the configuration illustrated in FIG. 14.
Figure 14:
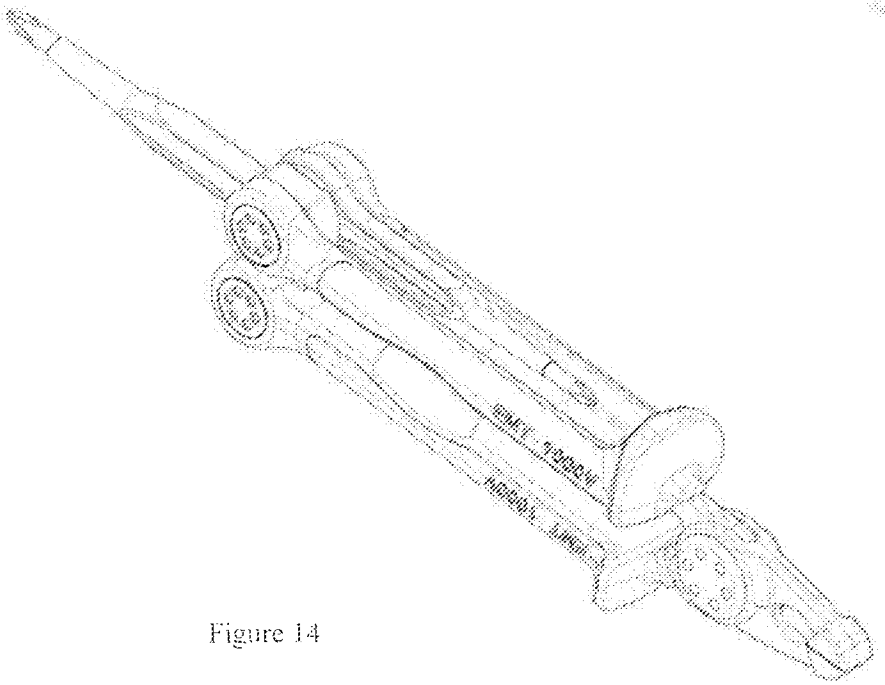
FIG. 14 shows the multi-tool illustrated in FIG. 10, with one tool in the use position.
Figure 16:
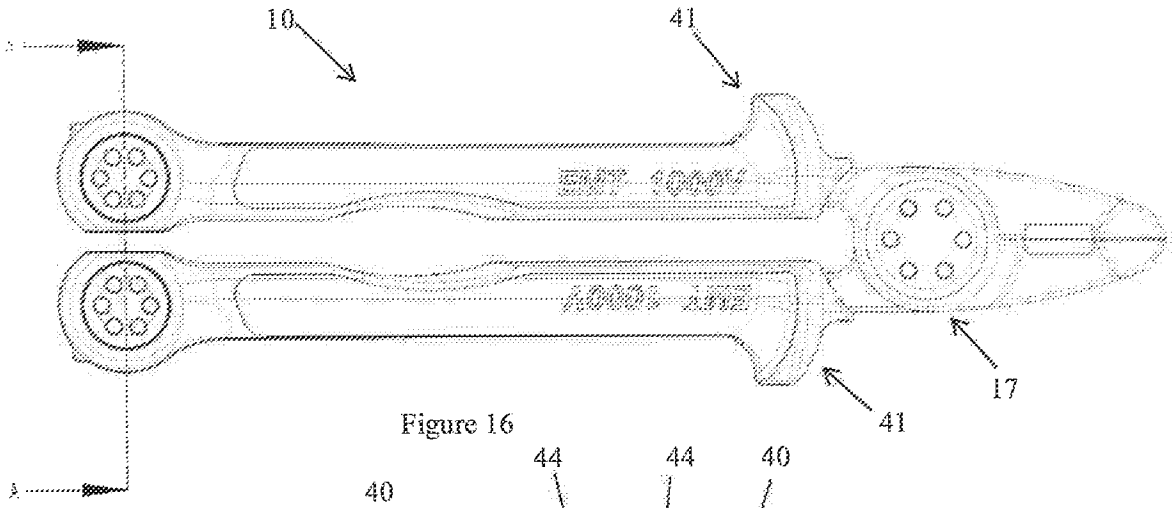
FIG. 16 is a view from the side of a multi-tool according to a preferred embodiment of the present invention.

In an alternative embodiment such as that illustrated in FIG. 2, the handles may include an outer insulating griping portion 25 over a metal handle tang 26.

Each of the tools themselves also has an insulating sleeve 28 provided over the majority of the length of the tool.

Figure 18:
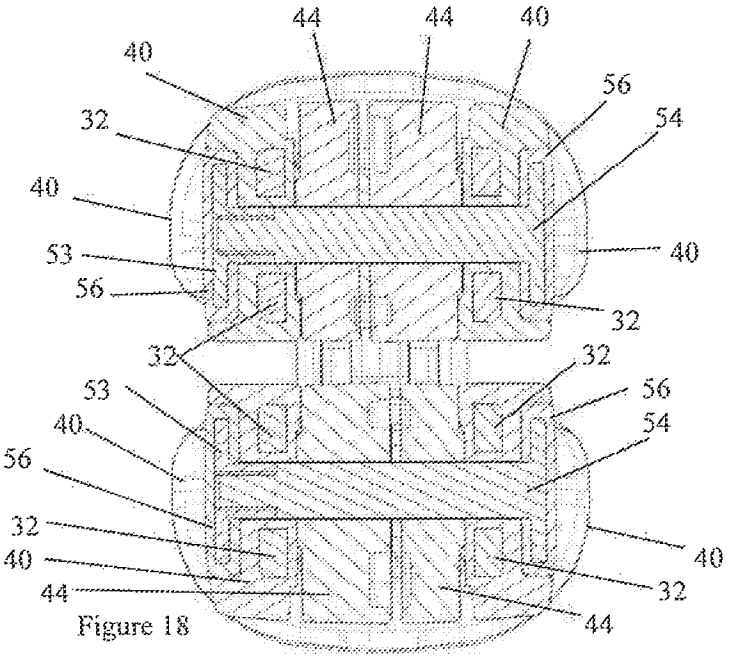
FIG. 18 is an enlarged view of FIG. 17.
Figure 17:
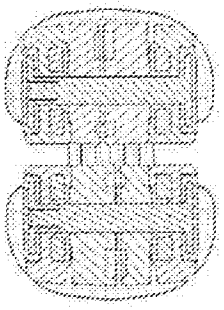
FIG. 17 is a section view along line A-A in FIG. 16.
Figure 19:
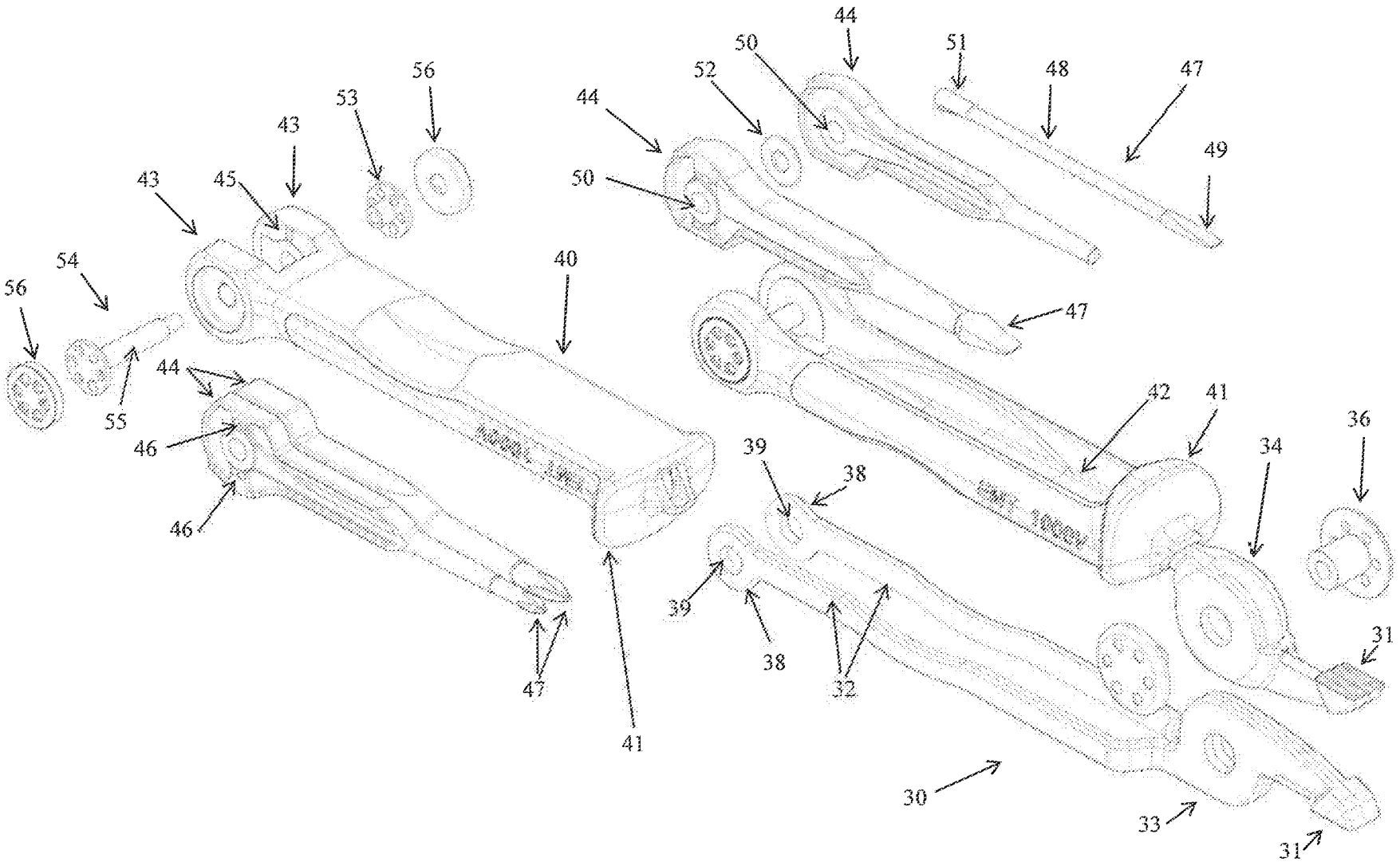
FIG. 19 is an exploded isometric view of the multi-tool illustrated in FIG. 8.
Figure 21:
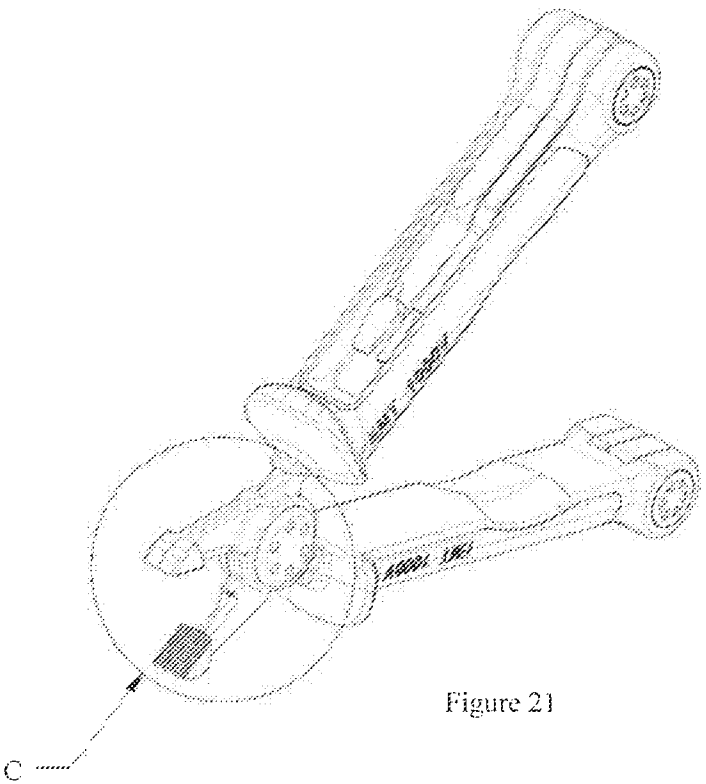
FIG. 21 is an isometric view of the multi-tool illustrated in FIG. 20.
Figure 20:
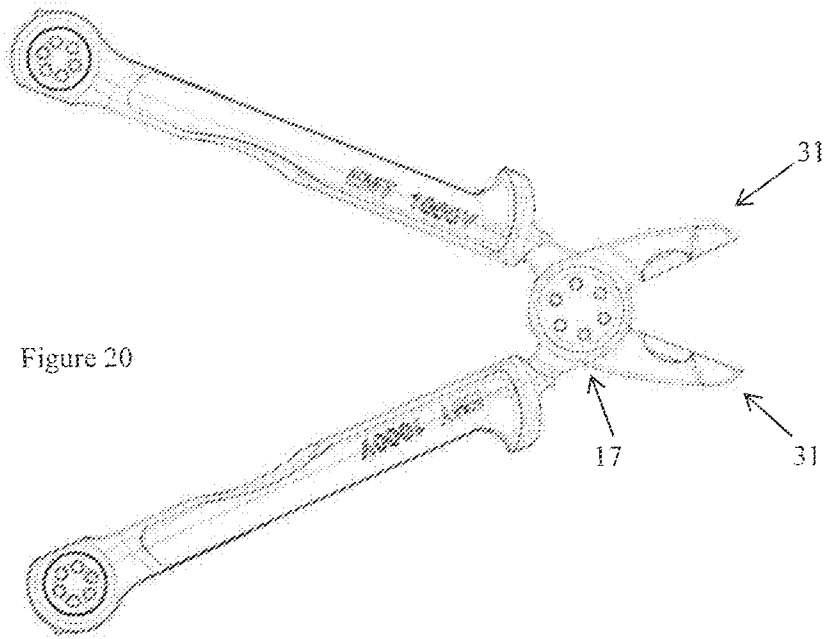
FIG. 20 is a view from the side of a multi-tool of a preferred embodiment in an open condition.
Figure 22:
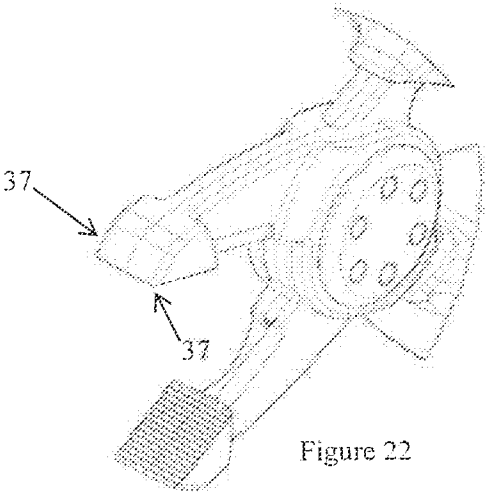
FIG. 22 is a detail view of the portion identified in FIG. 21 using Reference letter C.
Figure 24:
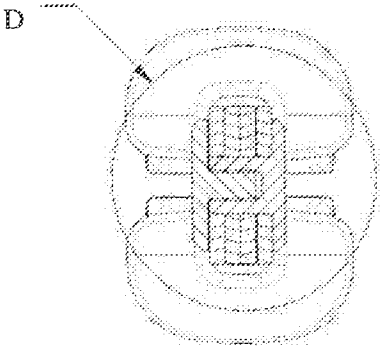
FIG. 24 is a section view along line B-B in FIG. 23.
Figure 23:
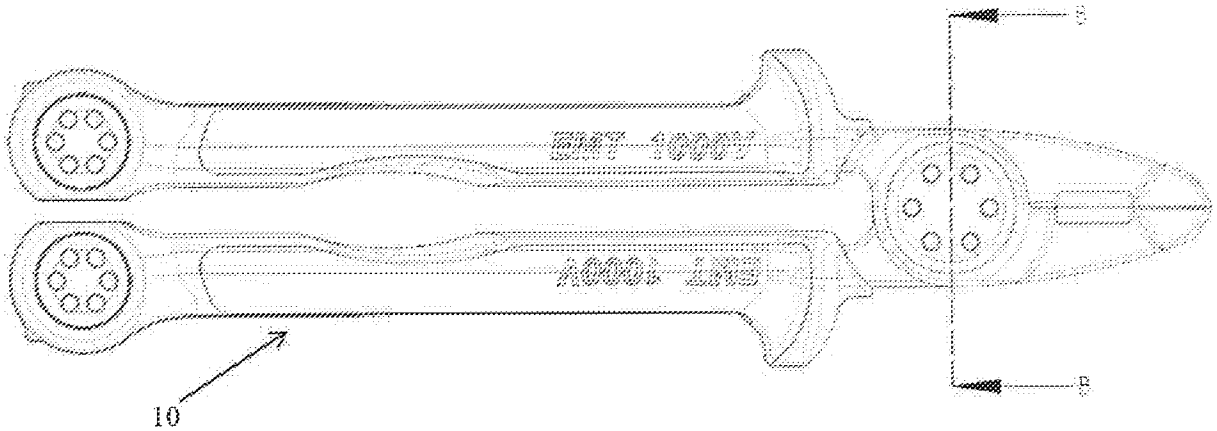
FIG. 23 is a view from the side of a multi-tool of a preferred embodiment.
Figure 25:
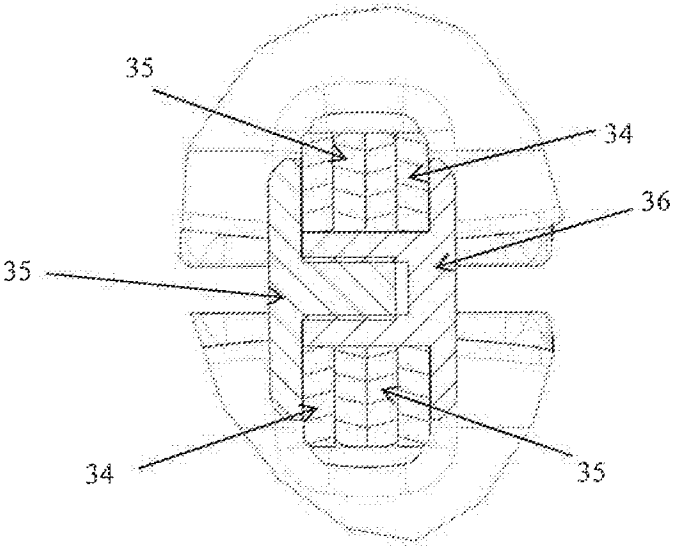
FIG. 25 is a detail view of the portion identified in FIG. 24 using Reference letter D.

The multi-tool of the embodiment illustrated in FIGS. 3 to 25 is similar in many respects to that illustrated in FIGS. 1 and 2. The most apparent differences are best illustrated in FIGS. 18 and 19. The multi-tool illustrated in FIGS. 3 to 25 includes a pair of opposed metallic bodies 30, best illustrated in FIG. 19 (only one body is illustrated as the upper handle already has an overmoulded grip), which are pivotally connected to one another at a pivot point, each body 30 having a jaw 31 and a handle portion with the handle portion having a pair of spaced apart arms 32. The pivot point includes an inner pivot portion 33 on one body and a receiving pivot portion 34 on the other, each with an opening which in assembly, are aligned and a pivot screw assembly of two corresponding screw portions 35, 36 is used to fix together.

In the illustrated preferred embodiment, each body 30 is formed by connecting two lateral body sides 37 together longitudinally. In the preferred embodiment, the body sides 37 are pressed together between the jaw 31 and a pivot portions 33, 34 with the pair of spaced apart arms 32 extending rearwardly from adjacent to, but behind that the pivot portions 33, 34. The body sides 37 are connected to one another using heat and pressure to effectively pressure weld the pair of metallic body sides 30 to one another.

As illustrated, the arms 32 are typically substantially parallel to one another and spaced apart to define a gap or space between which at least one tool is received when in the stored position as shown in FIGS. 3 to 11. Typically, each of the arms 32 has an enlarged rear portion 38, furthest from the jaws 31 with an opening 39 through which a locking screw is received in order to mount the tools relative to each of the aims 32. The locking screw (described further below) not only mounts the tools relative to the body 30, but also allows rotation of the tools between the stored and open positions.

An insulating handle portion 40 is over moulded over the body, extending from behind the pivot portions 33, 34 over the remainder of the arms 32. It is important that the over moulded insulating handle portion surrounds the spaced apart arms 32 on all sides of each of the arms 32 (as shown in FIG. 18) and typically, the over moulded handle portion 40 will surround the arms 32 on all sides up to a position adjacent to the portions 33, 34. The over moulded handle portion 40 will act to insulated the uses hand from the jaw and the arms from the tools.

The over moulded handle portion 40 has an enlarged forward guard portion 41 extending substantially radially about the handle portion 40 at a forward end.

The over moulded handle portion 40 includes a shaped channel 42, located between the pair of spaced apart arms 32 of the body 30 in order to receive the tools at least partially therein. In the preferred form, the channel 42 is elongate and rectangular in cross-section. Preferably, the channel 42 is longer than the tools, forming a void or empty portion at the jaw-end of the channel 42 in order to allow a user to insert their finger into the channel 42 at a forward end of the tools in order to manually release the tools from the stored position. The channel 42 extends rearwardly to a pair of spaced apart, enlarged wings 43 at the rear, between which the tool mounts 44 are mounted (described further below).

A latch mechanism is provided to releasably latch each tool in the stored and open positions. In the illustrated form, the latch mechanism includes a lug 45 provided on an inner portion of the spaced apart, enlarged wings 43 of the handle portion 40 with two sets of corresponding shaped depressions 46 provided on the over moulded tool mount 44, separated by 180° on the tool mount 44. The latch mechanism provides tactile and/or audible feedback of the movement of the tools into the stored and open positions.

Each of the tools 47 is provided with a metal shaft 48 located behind a tip or bit 49. An over moulded tool mount 44 is provided moulded over, completely about the shaft 49 of each tool 47. The over moulded tool mount 44 is manufactured from a nonconductive material and insulates the tool relative to the handle, particularly the locking screw and the jaws 31.

Each over moulded mount 44 is provided with an opening 50 to mount the tool relative to a respective handle portion 40 with the opening 50 provided in an enlarged tool mount portion.

Normally, the shaft 48 of each of the tools will stop short of the opening 50 used to mount the tool 47 relative to the handle. Typically, shaft 48 of each of the tools 47 is shaped to engage with the over moulded mount 44 to minimise and preferably substantially prevent rotation of the shaft 48 within the over moulded mount 44. For example, the shaft illustrated in FIG. 19 has at least one extension arrangement 51 extending radially from the shaft 48.

Each handle will typically have a pair of tools with the tools typically matched, for example a pair of flat screwdrivers on one handle with a pair of Philips head screwdrivers on the other handle. The tools are mounted for individual rotation. Typically, a bush 52 is provided between the over moulded mount 44 of each of the tools in order to allow easy independent rotation of one tool relative to the other.

The tools are mounted relative to a respective handle using a locking screw provided through an opening in each of the wings 43 of the over moulded handle portion 40 and through the openings 50 in the respective over moulded mount 44 of each of the tools 47. As illustrated in FIG. 19, the locking screw has a pair of corresponding portions 53, 54, each having an enlarged head, one of the portions 53 having an internally threaded opening and the other of the portions 54 having an elongate shank 55 with an externally threaded portion. As illustrated, the enlarged head of each of the portions 53, 54 have engagement formations to allow a tool to be engaged to lock and unlock the locking screw. The provision of a locking screw will allow a user to remove the screw to change tools if necessary. The enlarged head of each of the portions 53, 54 are over moulded 56 with an insulating material. The locking screw is isolated from the spaced apart arms of the body is by the insulating over moulded handle and will also be isolated from the respective tools because of the over moulded mount as shown in FIG. 18.

The overmould material is important, firstly because the over mould material will primarily be nonconductive in order to insulate various portions of the multi-tool from each other but also, the material or materials chosen will need to be resilient where required for comfort but more rigid and strong in areas where load will be experienced for example, about the tool mount. One or more nonconductive materials can be used in order to provide particular material. characteristics in locations as required. Generally, in any position where torque may be experienced during use of the tool, multiple materials could be used with one of the materials used preferably being a rigid and/or stronger material more centrally located and a softer, more comfortable material provided at or towards an outer portion for comfort during use.

Any form of insulating member or material may be used but a particularly preferred material will be XHHW cross linked polyethylene or PVC with nylon coating. The insulating member or material used will preferably be able to fully insulate the user from the operating surfaces of the multi-tool and the individual tools up to approximately 1000 V.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

The invention claimed is:

1. An insulated multi-tool comprising:

a pair of opposing jaws, a pair of opposed handles operatively connected to the jaws relative to a pivot to force the jaws into a clamping position about an object, at least one of the opposed handles having a tool-receiving pocket, wherein the tool receiving pocket comprises a locking screw assembly, the locking assembly comprising a pair corresponding portions with each portion having an enlarged head, one of the portions having an internally threaded opening and the other of the portions having an elongated shank with an externally threaded portion, each enlarged head having engagement formations to allow locking and unlocking the screw assembly, wherein the enlarged head of each of the portions are over moulded with insulating material, and at least one tool stored in the tool receiving pocket, the at least one tool pivotally attached relative to the locking screw assembly of the tool receiving pocket for movement between a stored position in which the at least one tool is stored within the tool receiving pocket and an open, use position in which the at least one tool is located relative to at least one of the opposed handles for use, wherein each of the pair of opposed handles comprise a respective over mould adapted to electrically insulate the pair of opposing jaws, each at least one tool and the locking screw assembly, and wherein each at least one tool comprises a tool over mould adapted to electrically insulate the at least one tool from the locking screw assembly.

2. An insulated multi-tool as claimed in claim 1 wherein each of the jaws is a combination jaw including a cutting blade as well as one or more gripping portions.

3. An insulated multi-tool as claimed in claim 1 wherein each of the handles has at least one elongate tool-receiving pocket that extends approximately parallel to a longitudinal axis of the handle.

4. An insulated multi-tool as claimed in claim 1 wherein the at least one tool is attached relative to the one of the tool-receiving pockets by a pin so that the tool is pivotable from a closed position to an open position extending away from the one of the tool-receiving pockets.

5. An insulated multi-tool as claimed in claim 1 wherein the insulated multi-tool includes a pair of opposed bodies pivotally connected to one another at the pivot with an inner pivot portion and a receiving pivot portion, each body having a jaw and a handle portion with at least one body having a pair of spaced apart arms in a handle portion.

6. An insulated multi-tool as claimed in claim 5 wherein both bodies have a pair of spaced apart arms in the handle portion.

7. An insulated multi-tool as claimed in claim 5 wherein each body is formed by connecting two lateral body sides together longitudinally.

8. An insulated multi-tool as claimed in claim 7 wherein the body sides are connected to one another using heat and pressure to pressure weld the body sides to one another.

9. An insulated multi-tool as claimed in claim 5 wherein the spaced apart arms are substantially parallel to one another and spaced apart to define a gap or space between to form a pocket into which the at least one tool is received when in the stored position.

10. An insulated multi-tool as claimed in claim 5 wherein each of the arms has an enlarged rear portion with an opening through which a pin or locking screw is received in order to mount the at least one tool relative to each of the arms.

11. An insulated multi-tool as claimed in claim 5 wherein an insulating handle portion is over moulded, the spaced apart arms up to the pivot portions.

12. An insulated multi-tool as claimed in claim 11 wherein the insulating handle portion surrounds each of the spaced apart arms on all sides of each of the arms and define a shaped pocket channel therebetween.

13. An insulated multi-tool as claimed in claim 12 wherein the channel is elongate, longer than the at least one tool to form a void or empty portion of the channel at a forward end of the at least one tool in order to allow a user to manually release the at least one tool from the stored position.

14. An insulated multi-tool as claimed in claim 11 wherein the handle portion has an enlarged forward guard portion extending substantially radially about the handle portion adjacent to the pivot.

15. An insulated multi-tool as claimed in claim 14 wherein an insulating material is used to insulate a user from any operating surfaces of the jaws and each at least one tool up to approximately 1000 V by being molded over conducting portions of the handle and each at least one tool to isolate the user from the operating surfaces.

16. An insulated multi-tool as claimed in claim 5, further comprising a latch to releasably latch the at least one tool in the stored and/or open positions, the latch including a lug provided on an inner portion of a pair of spaced apart, enlarged wings of an insulated handle portion with two sets of corresponding shaped depressions provided on a tool mount for the at least one tool to provide at least tactile feedback when the at least one tool moves into the stored and/or open positions.

17. An insulated multi-tool as claimed in claim 1 wherein the at least one tools has a metal shaft located behind a tip or bit and an over moulded tool mount of nonconductive material provided completely about the shaft of each at least one tool.

18. An insulated multi-tool as claimed in claim 17 wherein the over moulded mount is provided with an opening opposite the tip or bit to mount the tool relative to a respective insulated handle portion.

19. An insulated multi-tool as claimed in claim 18 wherein the shaft of the tool stops short of the opening used to mount the over moulded tool mount relative to the insulated handle portion.

20. An insulated multi-tool as claimed in claim 1 wherein each handle has a pair of tools mounted for individual rotation.

21. An insulated multi-tool as claimed in claim 1 wherein each handle has a bush provided between an over moulded tool mount that allows for a pair of tools to independently rotate within the over moulded tool mount.

* * * * *